US006662469B2

(12) United States Patent
Belley et al.

(10) Patent No.: US 6,662,469 B2
(45) Date of Patent: Dec. 16, 2003

(54) FOOTWEAR CONSTRUCTION AND METHOD FOR MANUFACTURING SAME

(75) Inventors: Manon Belley, Laval (CA); Tuan Nguyen Le, Portland, OR (US); Grant Urie, Shelburne, VT (US)

(73) Assignee: Wolverine World Wide, Inc., Rockford, MI (US)

( * ) Notice: Subject to any disclaimer, the term of this patent is extended or adjusted under 35 U.S.C. 154(b) by 71 days.

(21) Appl. No.: 10/004,022

(22) Filed: Oct. 31, 2001

(65) Prior Publication Data

US 2003/0079374 A1 May 1, 2003

(51) Int. Cl.[7] ..... A43B 9/10; A43B 3/14

(52) U.S. Cl. ..... 36/16; 36/11; 36/19 R; 12/142 B; 12/142 T

(58) Field of Search ..... 36/11, 16, 19 R, 36/21; 12/142 B, 142 T

(56) References Cited

U.S. PATENT DOCUMENTS 1,871,763 A * 8/1932 Wiggin ..... 36/11
1,972,339 A * 9/1934 Grosz ..... 36/16
4,519,148 A 5/1985 Sisco
5,682,685 A * 11/1997 Terlizzi ..... 36/8.3
6,076,284 A * 6/2000 Terlizzi ..... 36/103
6,438,868 B1 * 8/2002 Fini ..... 36/16

OTHER PUBLICATIONS

Trippen shoe, Exhibits 1–4.

* cited by examiner

*Primary Examiner*—Ted Kavanaugh
(74) *Attorney, Agent, or Firm*—Warner Norcross & Judd LLP

(57) ABSTRACT

A "wrap-around" shoe construction having a generally horizontal seam that joins the upper and bottom. The sole includes separate heel and forefoot sole portions that expose the "wrap-around" upper. The horizontal seam preferably extends substantially parallel to the bottom line of the foot. The horizontal seam includes an outwardly-turned moc stitch in the forefoot and heel regions, and an inwardly turned butt stitch in the arch region. The present invention also provides a method for manufacturing an article of footwear including the steps of (1) forming the upper, (2) forming the bottom, (3) stitching the bottom to the upper along a horizontal seam, (5) lasting the upper and bottom assembly, (6) setting the shape of the upper and bottom assembly, (7) forming the outsole from separate forefoot and heel portions, and (8) installing a molded insole and a footbed in the shoe.

33 Claims, 9 Drawing Sheets

FOOTWEAR CONSTRUCTION AND METHOD FOR MANUFACTURING SAME

BACKGROUND OF THE INVENTION

The present invention relates to footwear, and more particularly to the construction of an article of footwear and the method for manufacturing footwear in accordance with this construction.

There is an ongoing effort to develop footwear constructions that provide improved comfort at a reduced cost while providing aesthetic appeal. In one conventional construction, a shoe is provided with an upper material that wraps entirely around the foot and a sole that is affixed to the material on the bottom of the shoe in two distinct portions, one located in the heel region and one in the forefoot region. The upper material therefore visibly wraps beneath the shoe in the arch region, providing a unique aesthetic appeal. A leather insole is secured in the upper to integrate the forefoot and heel portions and to provide the sole with a certain level of rigidity and support. This prior art construction is illustrated in FIGS. 1–3. The prior art shoe 200 includes a wrap-around upper 202 and a two-piece sole 204. The sole 204 includes a heel portion 222 and a forefoot portion 224 that are spaced apart in the arch region to expose the wrap-around upper 202. As shown, the upper 202 includes various pieces of leather that are stitched together to form an envelope that encloses the entire foot. The upper 202 includes a vamp piece 208 that wraps over the forefoot region and is stitched together along a seam 210 extending longitudinally along the approximate center of the bottom the shoe. The upper 202 also includes one or two pieces of material 212 that wrap around the heel region. The heel piece(s) 212 are stitched to the vamp piece 208 along an angled, but near to vertical, seam 214. If two heel pieces are included in the construction, they may be stitched to one another along a seam (not shown) extending longitudinally along the approximate center of the bottom shoe (where it is hidden by the heel portion 222 of the sole 204) and then up along the rear of the shoe (where it is hidden by the backstay 216). The upper 202 also includes an eyestay 218 stitched around the tongue opening 220. A leather insole 226 is fitted within the shoe.

Although providing a desirable aesthetic appearance, this conventional construction suffers from a number of drawbacks. First, this construction requires a large vamp piece that extends entirely around the shoe. The vamp piece must be large enough to extend from one side the bottom center of the shoe, around the top of the shoe and back down to the other side of the bottom center of the shoe. This can dramatically increase material costs, particularly when the upper is formed from high-grade leather. Second, the shoe includes a heel piece that is joined to the vamp piece along a substantially vertically extending stitch. At the same time, the vamp piece wraps entirely around the arch and forefoot regions seamed only along the bottom center of the shoe. Accordingly, the shape of the upper in the arch and forefoot regions is largely created by deforming the vamp piece on the last. This may lead to an undesirable amount of stretching of the leather, which can buckle, bulge or otherwise misshape the material. Third, the leather insole does not provide the level of support and stability desirable for certain activities.

SUMMARY OF THE INVENTION

The aforementioned problems are overcome by the present invention wherein a footwear construction with a "wrap-around" upper and separate heel and forefoot sole portions is provided with an upper and a bottom that are joined along a substantially horizontal seam. The horizontal seam is preferably disposed slightly above the sole and is preferably shaped to extend substantially parallel to the bottom line of the foot.

In a preferred embodiment, the horizontal seam includes an outwardly-turned moc stitch in the forefoot and heel regions, and an inwardly turned butt stitch in the arch region. The upper and bottom are preferably cemented along the stitching margin in the forefoot and heel regions to enhance the attachment and resist delamination of the stitched components.

In a more preferred embodiment, the sole includes separate forefoot and heel portions and a molded insole that is fitted within the upper atop the bottom bridging the forefoot and heel portions of the sole. The molded insole preferably extends through the heel and arch regions terminating in the forefoot region in approximately alignment with the ball of the foot. This provides the heel and arch regions with the desired level of stability while permitting the forefoot to bend and flex as desired.

The present invention also provides a method for manufacturing an article of footwear. The method generally includes the steps of (1) forming the various pieces of the upper, (2) stitching the upper pieces to define a horizontally extending margin, (3) attaching a shank to a bottom leather piece, (4) stitching the bottom leather piece to the upper along the horizontal seam, (5) lasting the upper and bottom leather assembly, (6) setting the shape of the upper and bottom leather assembly, (7) forming the outsole from separate forefoot and heel portions, and (8) installing a molded insole and a footbed in the upper. The horizontal stitch is preferably formed with a moc stitch in the forefoot and heel regions and an interior stitch in the arch region.

The present invention provides an article of footwear that provides a desired aesthetic appeal while enhancing comfort and reducing the costs associated with the manufacture of conventional constructions of similar design. The horizontal seam permits the upper to be manufactured from smaller pieces of material, which can significantly reduce material costs, particularly when the upper is formed of leather. The horizontal seam further permits the upper to more closely follow the shape of the foot with reduced stretching of the upper on the last. This is further enhanced by a curved horizontal seam the follows the bottom line of the foot. The use of an outsole with separate forefoot and heel regions reduces the necessary amount of outsole materials. The molded insole permits the forefoot region of the shoe to flex as desired while also providing the arch and heel regions with support and stability.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
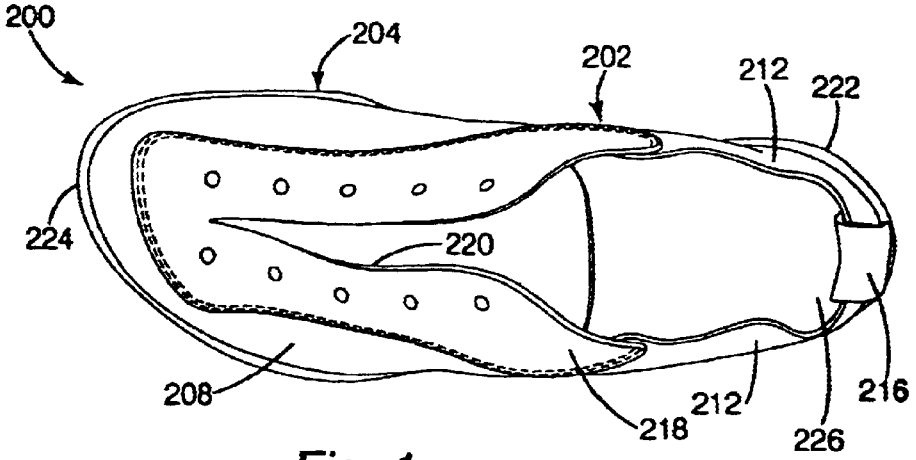
Fig. 1 (Prior Art)
FIG. 1 is a top plan view of a prior art construction.
Figure 2:
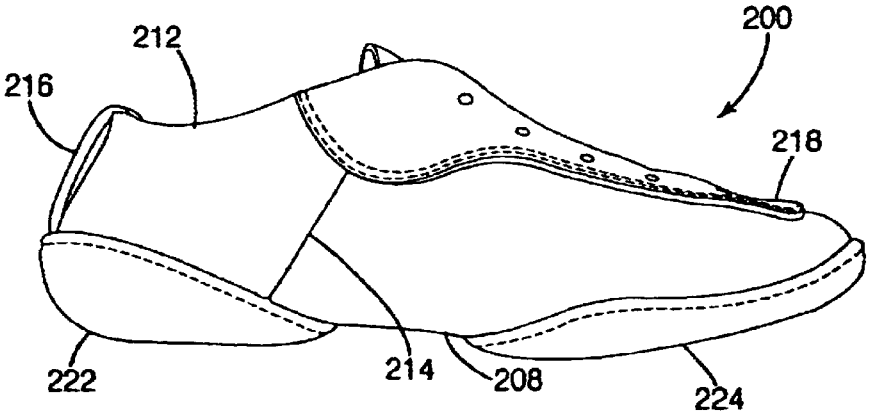
Fig. 2 (Prior Art)
FIG. 2 is a side elevational view of the prior art construction.
Figure 3:
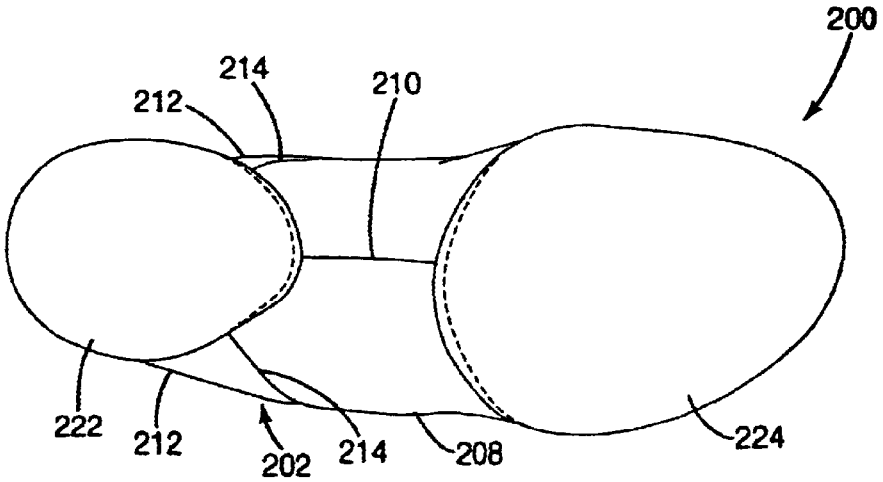
Fig. 3 (Prior Art)
FIG. 3 is a bottom plan view of the prior art construction.
Figure 4A:
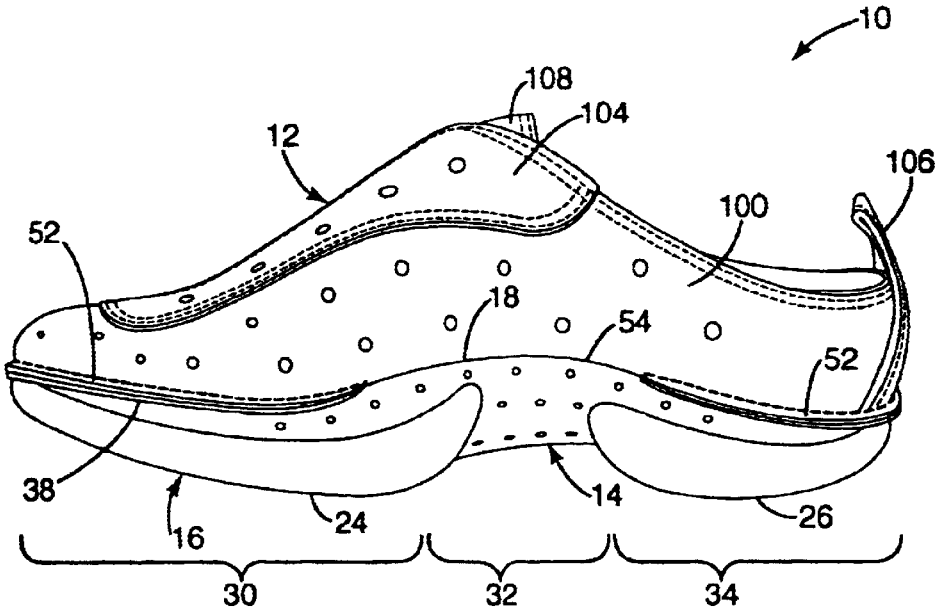
FIG. 4A is a right side elevational view of a shoe constructed in accordance with a preferred embodiment of the present invention.
Figure 4B:
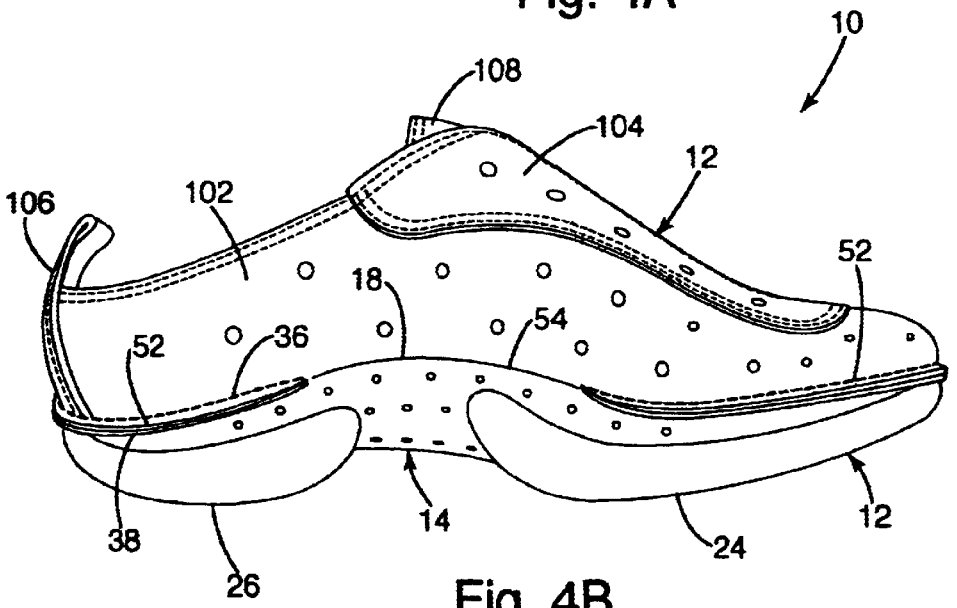
FIG. 4B is a left side elevational view of the shoe.
Figure 5:
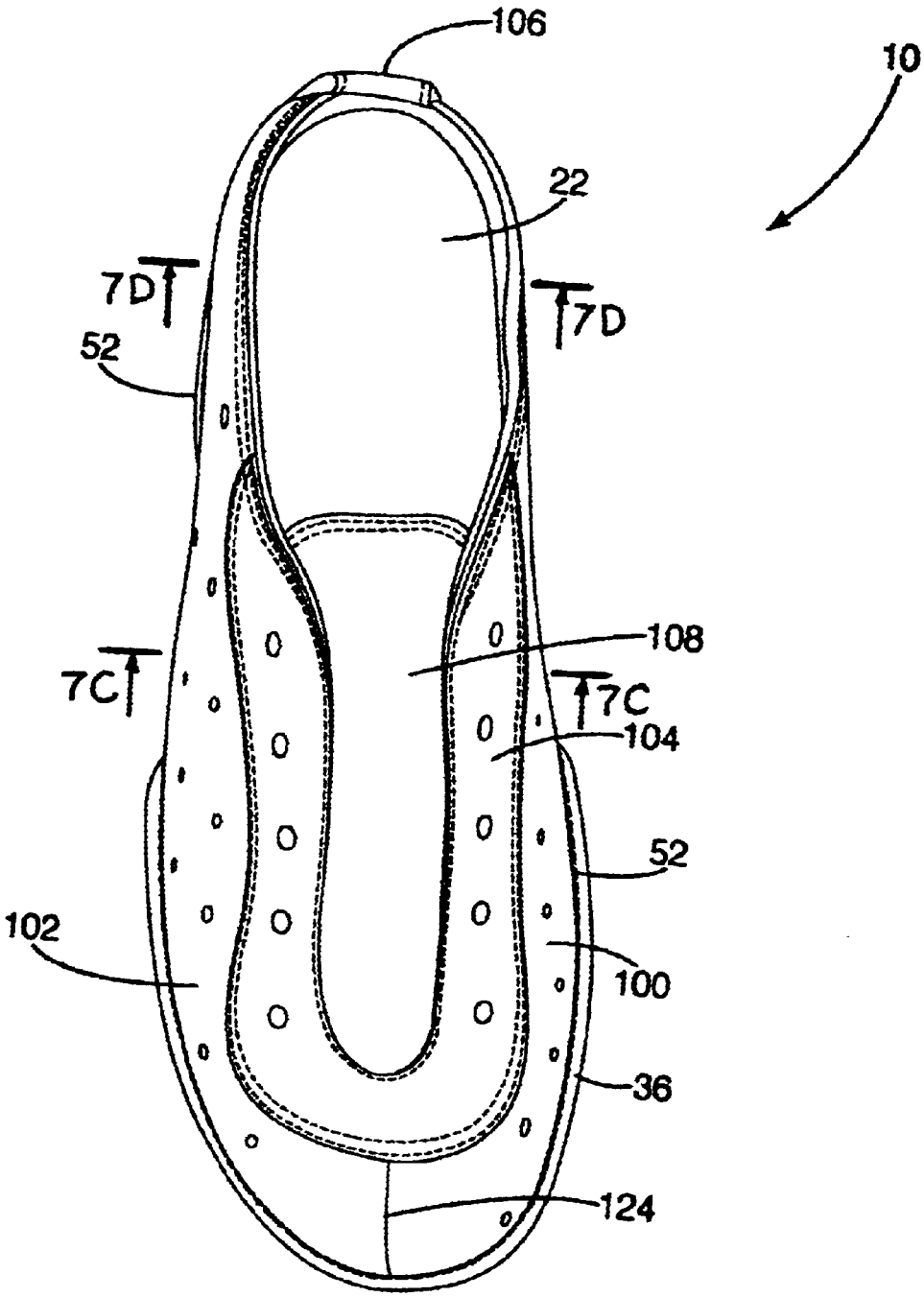
FIG. 5 is a top plan view of the shoe.
Figure 6:
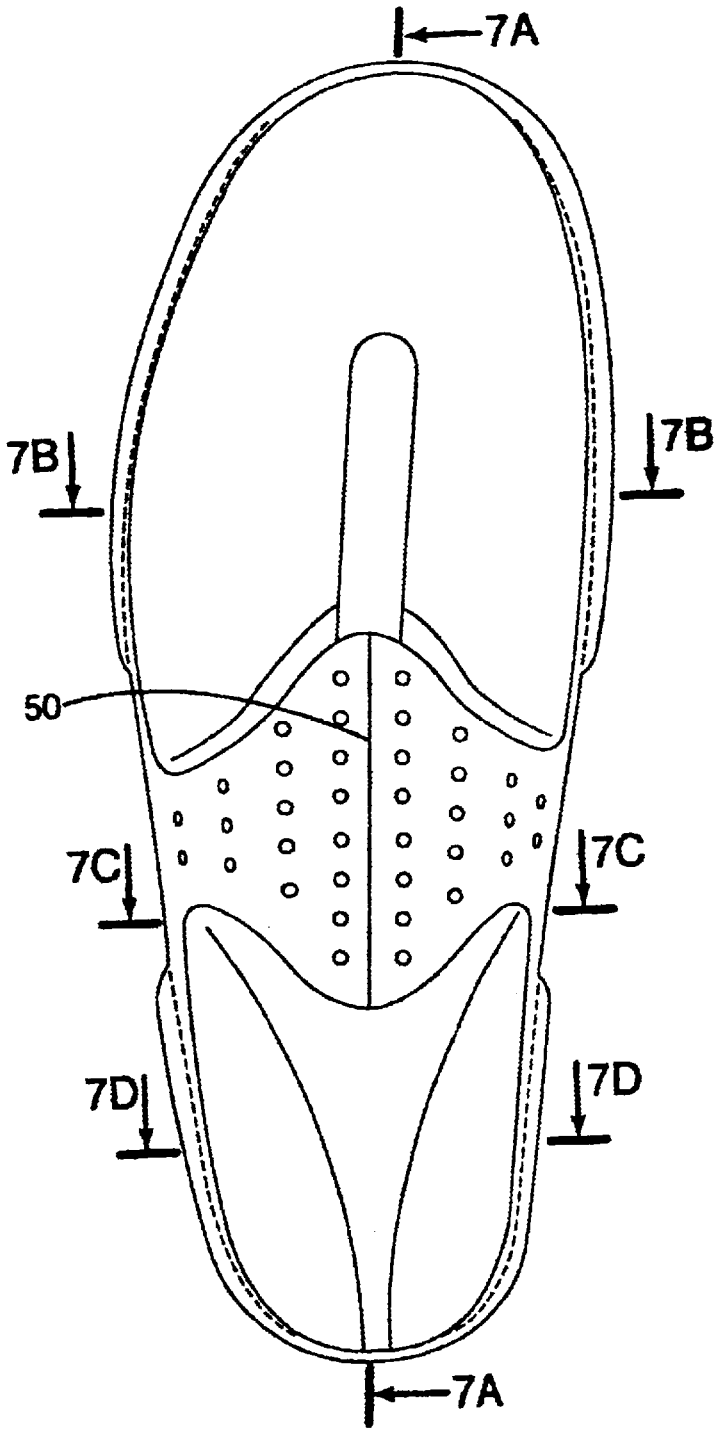
FIG. 6 is a bottom plan view of the shoe.
Figure 7A:
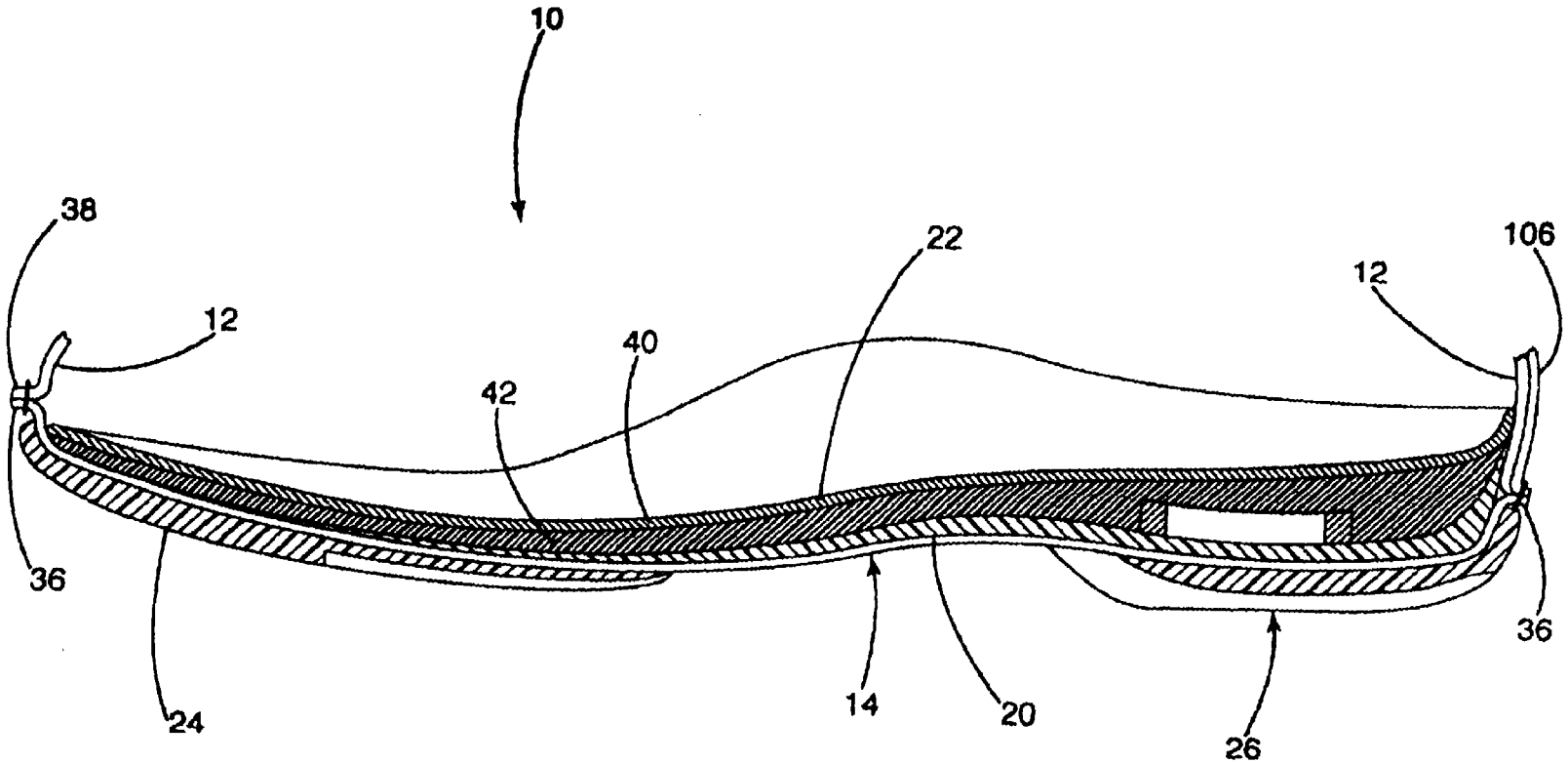
FIG. 7A is a sectional view of a portion of the shoe taken along line 7A—7A of FIG. 5.
Figure 7B:
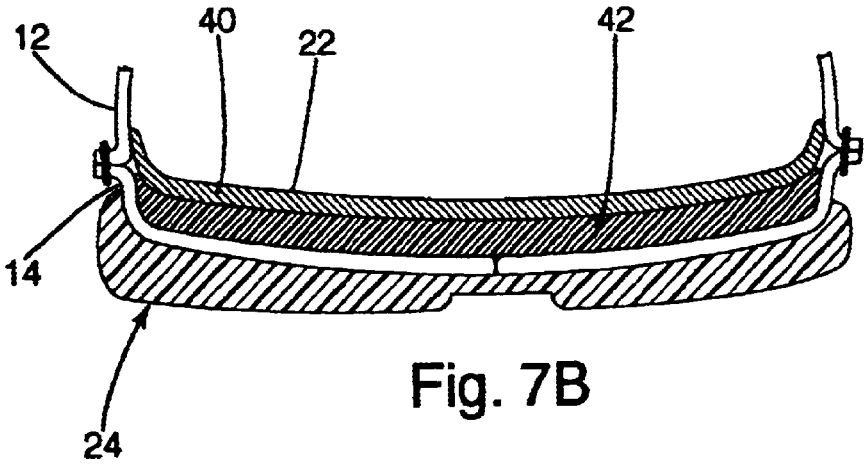
FIG. 7B is a sectional view of a portion of the shoe taken along line 7B—7B of FIG. 5.
Figure 7C:
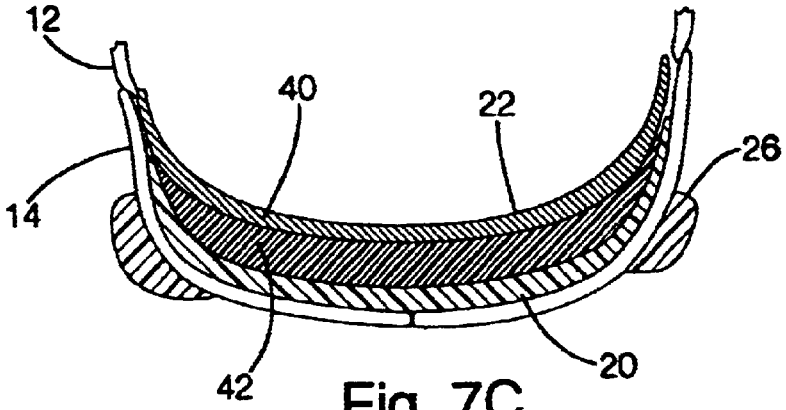
FIG. 7C is a sectional view of a portion of the shoe taken along line 7C—7C of FIG. 5.
Figure 7D:
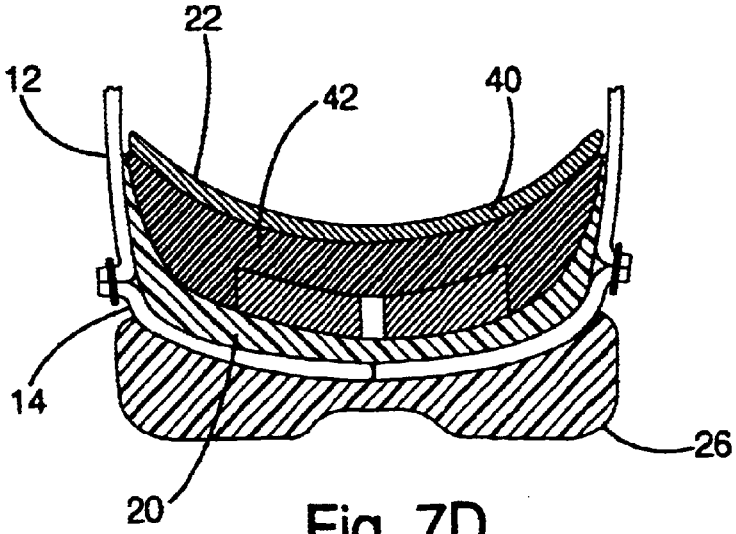
FIG. 7D is a sectional view of a portion of the shoe taken along line 7D—7D of FIG. 5.

A shoe manufactured in accordance with a preferred embodiment of the present invention is shown in FIG. 4 and generally designated 10. The shoe 10 includes an upper 12, a bottom 14 and an outsole 16. As shown in FIG. 7, the shoe 10 also includes an insole 20 and a footbed 22 that are fitted within the upper 12. The upper 12 and bottom 14 are stitched together along a substantially horizontal seam 18. The outsole 16 includes separate forefoot and heel portions, 24 and 26, respectively. Although the present invention is described in connection with an aftersport shoe, the present invention is well-suited for use with other conventional categories of footwear. In this application, the term "arch region" refers generally to that portion of the shoe corresponding to the arch of the wearer's foot, the term "forefoot region" refers generally to the portion of the shoe forward of the arch region corresponding the forefoot (e.g. ball and toes) of the wearer's foot, and the term "heel region" refers generally to that portion of the shoe rearward of the arch region corresponding to the heel of the wearer's foot. The forefoot region 30, arch region 32 and heel region 34 are identified in FIG. 4.

Figure 8A:
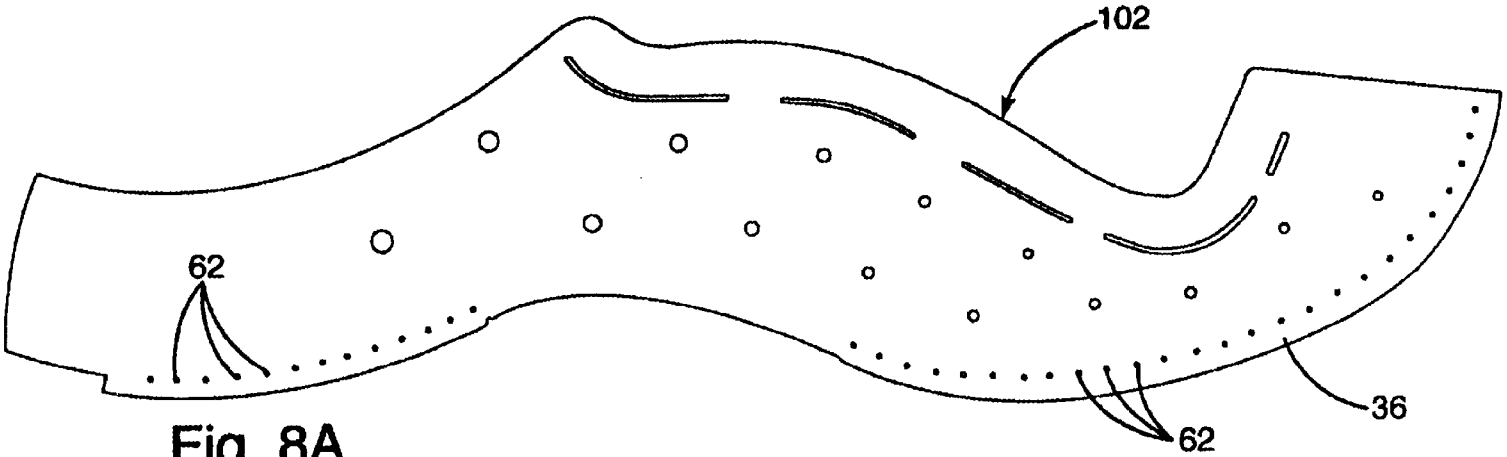
FIGS. 8A–E are plan views of the various upper pieces.
Figure 8B:
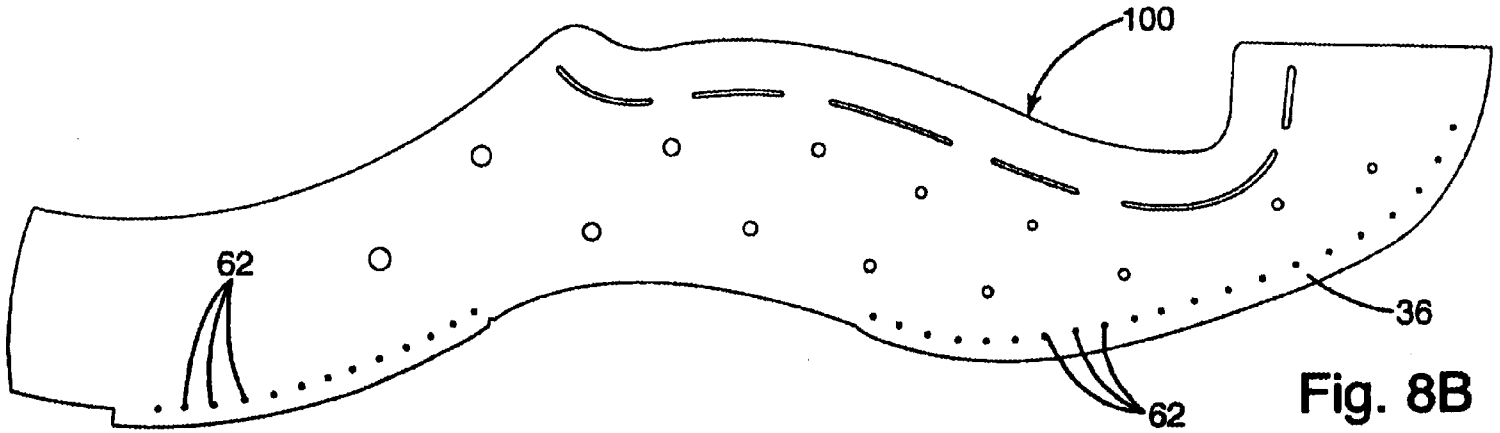
Figure 8D:
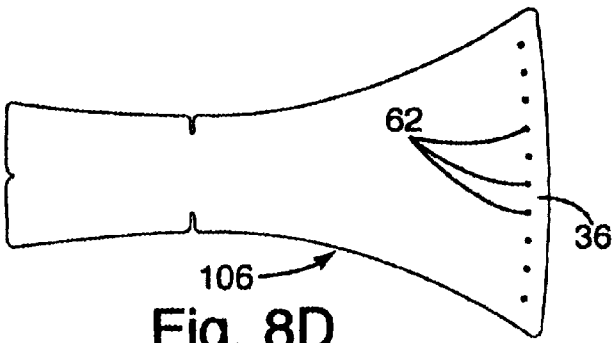
Figure 8E:
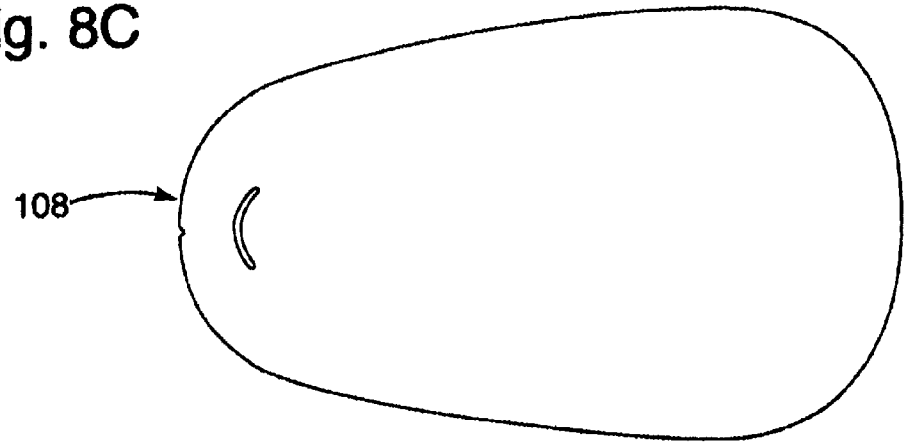
Figure 8C:
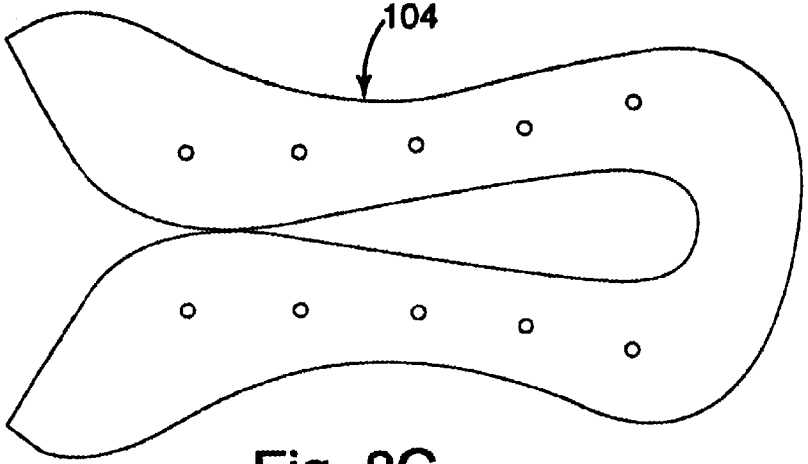

As described above, the upper 12 and the bottom 14 cooperatively define the foot-containing envelope of the shoe 10. Although the precise design and layout of the upper 12 will vary from application to applications, the upper 12 preferably includes inner quarter 100 (See FIG. 8B), outer quarter 102 (See FIG. 8A), eyestay 104 (See FIG. 8C), backstay 106 (See FIG. 8D) and tongue 108 (See FIG. 8E). The upper 12 includes a marginal allowance 36 extending around its periphery for securing the upper 12 to the bottom 14 as described in more detail below. The margin 36 varies in width between the forefoot 30, arch 32 and heel 34 regions to provide sufficient material for stitching the upper 12 to the bottom 14. As shown, the margin 36 in the forefoot and heel regions is wide enough to accommodate an outwardly turned moc stitch. The margin 36 in the arch region is significantly narrower, providing just enough material for an inwardly turned butt stitch.

Figure 9A:
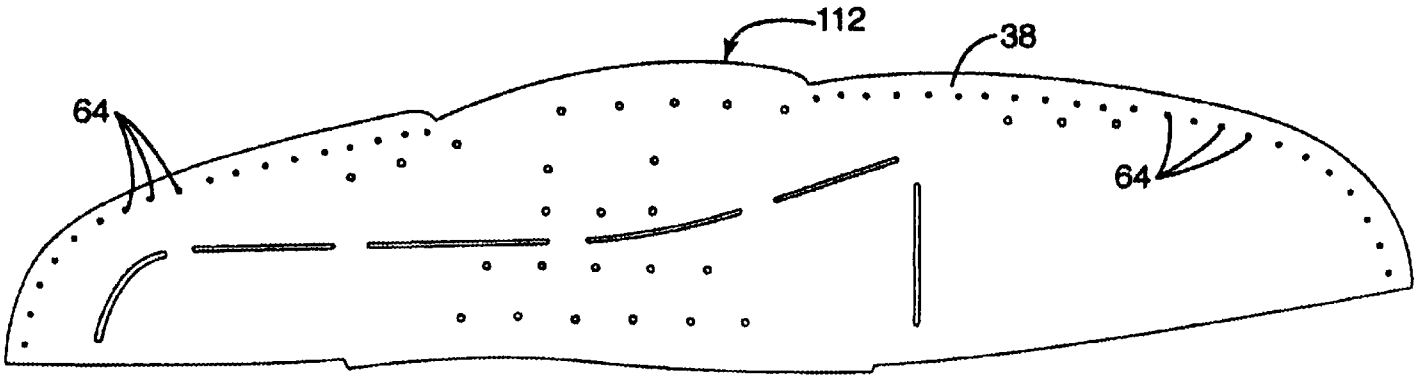
FIGS. 9A–B are plan views of the bottom pieces.
Figure 9B:
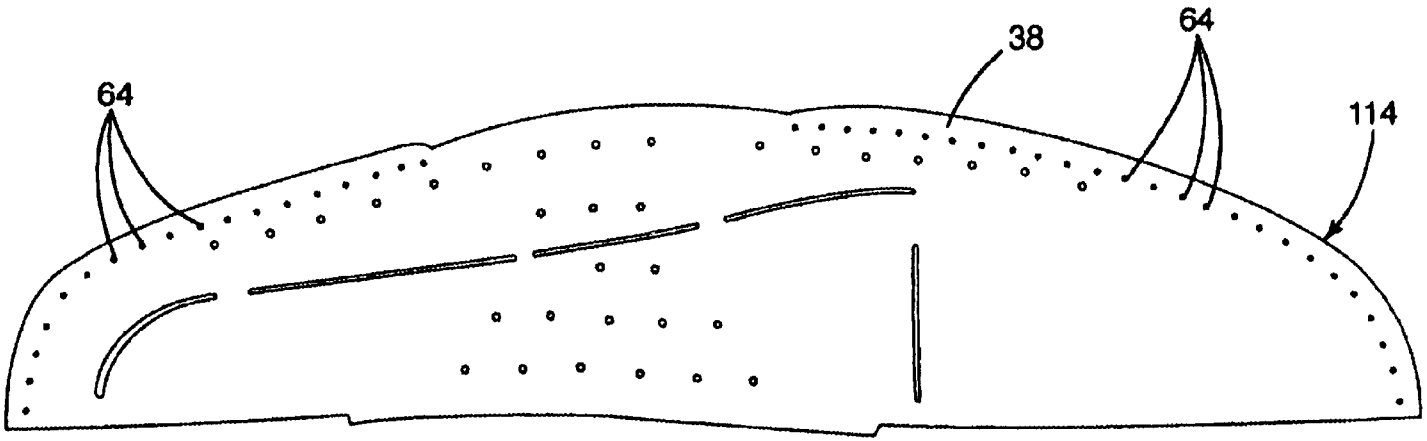

The bottom 14 preferably includes inner piece 112 (See FIG. 9A) and outer piece 114 (See FIG. 9B). The two pieces 112 and 114 extend longitudinally along inner and outer sides of the shoe 10 and are joined together along a longitudinal seam extending substantially along the center of the bottom 14. The bottom 14 includes a marginal portion 38 extending around its periphery for securing the bottom 14 to the upper 12. Referring now to FIG. 4, the bottom margin 38, like the upper margin 36, varies in width between the forefoot, arch and heel regions. The margin 38 in the forefoot and heel regions is wide enough to accommodate an outwardly turned moc stitch while the margin 38 in the arch region is narrower, providing just enough material for an inwardly turned butt stitch.

An insole 20 is cemented within the upper 12 to the top surface of the bottom 14. The insole 20 preferably extends only three-quarters of the length of the shoe 10 terminating in the forefoot region 30 in approximate alignment with the ball of the foot. The thickness of the insole 20 preferably tapers-off toward its forward edge. The insole 20 is preferably shaped to match the contour of the undersurface of a foot, providing a substantially rigid platform to support the arch and heel regions of the foot. Although the rigidity of the insole 20 can vary from application to application, the preferred insole 20 is sufficiently rigid to prevent flexing of the shoe 10 in the heel and arch regions under normal loads. As a result, the insole 20 eliminates the need for a conventional shank. The insole 20 is preferably manufactured from conventional materials, such as nylon or other polymeric materials.

A footbed 22 is removably fitted within the upper 12 atop the insole 20. The footbed 22 preferably extends the full length of the shoe 10 and is of a dual-density construction having upper 40 and lower 42 layers. The upper layer 40 is preferably manufactured from a cushioning material having a relatively low density. As a result, the upper layer 40 provides resiliency and cushioning under relatively small load, such as during sitting, standing or gentle movements. The lower layer 42 is preferably manufactured from a relatively high density material, providing resiliency and cushioning under heavier loads, such as during walking, running or jumping. A conventional sock liner (not shown) preferably covers the upper surface of the footbed 22.

As noted above, the outsole 16 includes a forefoot portion 24 and a heel portion 26. The two outsole portions, 24 and 26, are spaced apart from one another in the arch region. This makes the bottom 14 visible in the arch region providing a desirable aesthetic appeal. FIGS. 7A–7D are cross-sectional views showing the construction at various locations along the shoe 10. The forefoot portion 24 preferably extends through the forefoot region 30 of the shoe 10, providing a wear surface that engages the ground beneath the forefoot of the wearer's foot. The bottom surface of the forefoot portion 24 is preferably textured to provide improved traction. If desired, the forefoot portion 24 can include tread, lugs or other traction improving elements. The upper surface of the forefoot portion 24 is preferably shaped to correspond with the desired shape of the insole 20 and footbed 22. The heel portion 26 preferably extends through the heel region 34 of the shoe 10, providing a wear surface that engages the ground beneath the heel of the wearer's foot. The bottom surface of the heel portion 26 is preferably textured to provide improved traction. Like the forefoot portion 24, the heel portion 26 can include treads, lugs or other traction improving elements, as desired. The upper surface of the heel portion 26 is preferably shaped to correspond with the desired shape of the insole 20 and footbed 22. The forefoot portion 24 and heel portion 26 are preferably molded separately and secured to the bottom 14 by cement or other conventional adhesives. Alternatively, the forefoot portion 24 and heel portion 26 can be molded in place on the bottom using conventional direct attach molding techniques and apparatus.

MANUFACTURE AND ASSEMBLY

The shoe 10 is manufactured using conventional manufacturing equipment. The various pieces of the upper 12 are cut from the desired material, such as leather, using conventional techniques and apparatus. As described above, the upper 12 is preferably assembled from inner quarter 100, outer quarter 102, eyestay 104, backstay 106 and tongue 108 as shown in FIGS. 8A–E. The upper pieces are stitched together in a conventional manner to form the upper 12. For example, the inner quarter 100 is stitched to the outer quarter 102 in the toe region at seam 124 and in the heel region at a second seam (not shown). This second seam (not shown) is covered by backstay 106. It should be noted that the upper pieces are cut to define a margin 36 that functions as a stitching allowance extending around the periphery of the assembled upper 12. This margin 36 is cooperatively defined by the inner quarter 100, outer quarter 102 and backstay 106. The upper pieces are configured such that the margin 36 follows a substantially horizontal line (and more preferably a line that substantially follows the bottom line of a foot) when the upper 12 and bottom 14 are stitched together. Holes 62 may be preformed in the margin 36 in the inner quarter 100, outer quarter 102 and backstay 106 to facilitate the moc stitch 52 in those regions. The bottom pieces, namely inner piece 112 and outer piece 114, are also cut from the desired material using conventional techniques and apparatus (See FIGS. 9A–B). The bottom pieces are preferably cut from the same material as the upper pieces to provide the desired "wrap-around" appearance. The bottom pieces are cut to define a horizontal seam and to provide sufficient material to form margin 38. The bottom pieces are stitched together in a conventional manner to form the bottom 14. The seam 50 between the bottom pieces preferably extends longitudinally along the bottom center of the shoe 10. Holes 64 may be preformed in the margin 38 in the inner bottom piece 112 and the outer tom piece 114 to facilitate the moc stitch in those regions. The upper 12 and bottom 14 are preferably lined and reinforced with a conventional lining material (not shown), a conventional toe box (not shown) and other conventional reinforcing pieces (not shown) as desired.

The insole 20 is manufactured from a substantially rigid material, preferably from nylon or other polymeric material. As such, the insole 20 is preferably injection molded or die cast from a molten material, or vacuum formed from a sheet stock. The insole 20 may be manufactured using other conventional techniques and apparatus corresponding to the selected insole material. The manufacture insole 20 is adhered to the upper surface of the bottom 14 using conventional cements or other adhesives.

The upper 12 and bottom 14 are then stitched together using conventional apparatus. As noted above, the seam extends in a generally horizontal direction, and more preferably along a generally horizontally extending curve that runs parallel to the bottom line of the foot. Accordingly, the terms "generally horizontal" and "substantially horizontal" are intended to be sufficiently broad to encompass a line extending substantially parallel to the bottom line of a foot. As illustrated, the seam curves slightly upwardly as its extends from the back of the shoe toward the arch region. In the arch region, the seam in more dramatically curved, substantially following the curve of an arch of a foot. It should be noted that the seam preferably follows a higher arch on the medial side of the shoe than on the lateral side, much like the arch of a foot. The seam returns to a slight curve in the heel region. The curved seam facilitates shaping of the upper to match the shape of the foot. The upper 12 and bottom 14 are joined in the forefoot 30 and heel 34 regions by an outwardly turned moc stitch 52 (or cable stitch) that extends along margins 36 and 38. The moc stitch 52 may be hand or machine sewn as desired, preferably using a conventional moc-stitch thread. Before stitching the outwardly turned region, a layer of cement is applied between the two margins 36 and 38. The cement reduces the likelihood of separation, or delamination, of the two margins 36 and 38 in the outwardly turned region. The upper 12 and bottom 14 are joined in the arch region 32 using a conventional inwardly turned butt stitch 54. The butt stitch 54 may be machine or hand sewn as desired.

The upper 12 and bottom 14 assembly are then fitted over a conventional punch last (not shown). Although the shape of the shoe is primarily defined by the cut of the upper 12 and bottom 14 pieces, the punch last helps to set the shape the shoe 10. The upper 12 and bottom 14 assembly is preferably heat set to hold its shape.

The footbed 22 is a generally conventional dual-density footbed, having coextensive upper 56 and lower 58 layers of differing densities. The footbed 22 is manufactured using conventional techniques and apparatus, preferably from EVA, foamed polyurethane or other similar cushioning materials. A lining material (not shown) may cover the top surface of the footbed 22. The footbed 22 is preferably removably inserted into the shoe 10, but can be "permanently" secured if desired.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

What is claimed is:

1. An article of footwear comprising:

an upper including a top portion and a bottom portion, the top portion having a stitching allowance, the bottom portion having a stitching allowance, said top portion stitching allowance being stitched to said bottom portion stitching allowance along a seam extending substantially horizontally;

a sole heel portion secured to the bottom portion in a location corresponding to a heel region of a wearer; and a sole forefoot portion secured to the bottom portion in a location corresponding to a forefoot region of a wearer, said sole heel portion and said sole forefoot portion being non-continuous and spaced from one another a distance, wherein at least a portion of said bottom portion is exposed within an arch region of the shoe, and wherein said seam is located above and is separate from said sole heel portion and said sole forefoot portion.

2. An article of footwear comprising:

an upper having a stitching allowance;

a bottom having a stitching allowance, said upper stitching allowance being stitched to said bottom stitching allowance along a seam extending substantially horizontally; and a sole having separate heel and forefoot portions, said heel portion and said forefoot portion being spaced from one another to expose at least a portion of said bottom in an arch region of the shoe;

wherein said seam includes an outwardly-turned stitch in a forefoot region and a heel region, and an inwardly turned butt seam in an arch region.

3. The article of footwear of claim 2 further comprising an adhesive intersecuring said upper stitching allowance and said bottom stitching allowance along said outwardly-turned moc stitch.

4. The article of footwear of claim 3 further comprising an insole, said insole secured to said bottom and extending through said heel region and said arch region to provide said heel region and said arch region with a desired degree of rigidity.

5. The article of footwear of claim 4 wherein said insole is manufactured from a polymeric material.

6. The article of footwear of claim 5 further comprising a footbed disposed above said insole, said footbed being manufactured from a resilient material providing the article of footwear with the desired cushioning.

7. The article of footwear of claim 6 wherein said footbed is removably fitted above said insole.

8. The article of footwear of claim 2 wherein said seam extends substantially parallel to a bottom line of a wearer's foot.

9. An article of footwear comprising:

an upper having a marginal allowance extending around its periphery;

a bottom having a marginal allowance extending around its periphery, said bottom including an underside;

a seam joining said upper and said bottom at said upper marginal allowance and said bottom marginal allowance, said seam extending substantially horizontally, said seam including stitching extending through at least one of a forefoot region and a heel region; and a sole having a heel portion and a forefoot portion, said heel portion being spaced apart from said forefoot portion in an arch region, whereby said underside is exposed at least in said arch region, wherein said seam is located substantially above and is separate from said heel portion and said forefoot portion.

10. The article of footwear of claim 9 further comprising an adhesive intersecuring said upper marginal allowance and said bottom marginal allowance along said outwardly-turned moc stitch.

11. The article of footwear of claim 10 wherein said seam includes an outwardly-turned moc stitch extending through both of said forefoot region and said heel region.

12. An article of footwear comprising:

an upper having a marginal allowance extending around its periphery:

a bottom having a marginal allowance extending around its periphery:

a seam joining said upper and said bottom at said upper marginal allowance and said bottom marginal allowance, said seam extending substantially horizontally, said seam including an outwardly-turned moc stitch extending through at least one of a forefoot region and a heel region;

a sole having a heel portion and a forefoot portion, said heel portion being spaced apart from said forefoot portion in an arch region, whereby said bottom is exposed in at least the arch region;

an adhesive intersecuring the upper marginal allowance and the bottom marginal allowance along said outwardly-turned moc stitch;

wherein the outwardly-turned moc stitch extends through both the forefoot region and the heel region; and wherein said seam includes an inwardly-turned butt seam extending through said arch region.

13. The article of footwear of claim 12 further comprising an insole, said insole secured to said bottom and extending through said heel region and said arch region to provide said heel region and said arch region with a desired degree of rigidity.

14. The article of footwear of claim 13 wherein said insole is manufactured from a polymeric material.

15. The article of footwear of claim 14 further comprising a footbed disposed above said insole, said footbed being manufactured from a resilient material providing the article of footwear with the desired cushioning.

16. The article of footwear of claim 15 wherein said footbed is removably fitted above said insole.

17. The article of footwear of claim 12 wherein said seam extends substantially parallel to a bottom line of a wearer's foot.

18. A method for manufacturing an article of footwear having a wrap-around construction, comprising the steps of:

forming an upper with a stitching allowance extending around its periphery;

forming a bottom with a stitching allowance extending around its periphery;

securing an outsole to the bottom, the outsole having separate forefoot and heel portions, the forefoot portion and the heel portion being spaced apart from one another in an arch region to expose the bottom in at least the arch region; and stitching the bottom to the upper along a substantially horizontal seam, the seam joining the upper stitching allowance and the bottom stitching allowance, the seam being disposed substantially above and separate from the forefoot portion and the heel portion.

19. The method of claim 18 further comprising the steps of:

lasting the upper and the bottom following said stitching step; and heat setting the upper and the bottom while the upper and the bottom are on the last.

20. The method of claim 19 wherein said stitching step includes the steps of:

stitching an outwardly-turned moc stitch in a forefoot region;

stitching an inwardly-turned butt seam in said arch region; and stitching an outwardly-turned moc stitch in a heel region.

21. The method of claim 20 further including the step of joining the upper stitching allowance and the bottom stitching allowance with an adhesive at least through the forefoot outwardly-turned moc stitch and the heel outwardly-turned moc stitch.

22. The method of claim 21 wherein said stitching step includes forming the seam to extend substantially parallel to the bottom line of a wearer's foot.

23. The method of claim 22 wherein said securing step includes adhesively securing the forefoot portion and the heel portion to the bottom.

24. The method of claim 23 further comprising the step of installing an insole atop the bottom, the insole extending through the heel region and the arch region to terminate in substantial alignment with a ball of a wearer's foot.

25. The method of claim 24 wherein the insole is manufactured from a substantially rigid material, whereby said insole provide the bottom with a desired level of rigidity in the heel region and the arch region while permitting flexing in the forefoot region at least in a region substantially aligned with a ball of a wearer's foot.

26. The method of claim 25 further comprising the step of installing a footbed atop the insole, the footbed extending substantially through the heel region, the arch region and the forefoot region, the footbed being manufactured from a resilient material providing a desired level of cushioning.

27. A method for manufacturing an article of footwear having a wrap around construction, comprising the steps of:

forming an upper with a peripheral stitching allowance;

forming a bottom with a peripheral stitching allowance;

stitching the upper stitching allowance to the bottom stitching allowance in a forefoot region with an outwardly-turned moc stitch, the forefoot moc stitch extending substantially horizontally;

stitching the upper stitching allowance to the bottom stitching allowance in an arch region with an inwardly-turned butt stitch, the butt stitch extending substantially horizontally;

stitching the upper stitching allowance to the bottom stitching allowance in a heel region with an outwardly-turned moc stitch, the heel moc stitch extending substantially horizontally;

attaching a sole to the bottom, the sole including a heel portion and a forefoot portion, the heel portion being spaced apart from the forefoot separate portion in the arch region to expose the bottom in at least the arch region.

28. The method of claim 27 further including the step of joining the upper stitching allowance and the bottom stitching allowance with an adhesive at least through the forefoot moc stitch and the heel moc stitch.

29. The method of claim 28 wherein the forefoot moc stitch, the arch butt stitch and the heel moc stitch extend substantially parallel to a bottom line of a wearer's foot.

30. The method of claim 29 further comprising the steps of:

lasting the upper and the bottom following said stitching steps; and heat setting the upper and the bottom while the upper and the bottom are on the last.

31. The method of claim 30 wherein said sole attaching step includes adhesively securing the forefoot portion and the heel portion to the bottom.

32. The method of claim 31 further comprising the step of installing an insole atop the bottom, the insole extending through the heel region and the arch region to terminate in substantial alignment with a ball of a wearer's foot.

33. The method of claim 32 further comprising the step of installing a footbed atop the insole, the footbed extending substantially through the heel region, the arch region and the forefoot region, the footbed being manufactured from a resilient material providing a desired level of cushioning.

* * * * *